US011199124B2

(12) United States Patent
Takagi et al.

(10) Patent No.: US 11,199,124 B2
(45) Date of Patent: Dec. 14, 2021

(54) COOLING APPARATUS FOR INTERNAL COMBUSTION ENGINE

(71) Applicants: TOYOTA JIDOSHA KABUSHIKI KAISHA, Toyota (JP); AISIN SEIKI KABUSHIKI KAISHA, Kariya (JP)

(72) Inventors: Noboru Takagi, Toyota (JP); Hirokazu Kato, Nisshin (JP); Rihito Kaneko, Miyoshi (JP); Naoto Hisaminato, Toyota (JP); Hirokazu Ando, Seto (JP); Masaaki Yamaguchi, Okazaki (JP); Hirotaka Watanabe, Anjo (JP); Masahiro Yoshida, Toyota (JP); Koji Nunami, Nagoya (JP); Naoto Yumisashi, Nagoya (JP); Masafumi Yoshida, Konan (JP); Takahiko Aoyagi, Anjo (JP)

(73) Assignees: TOYOTA JIDOSHA KABUSHIKI KAISHA, Toyota (JP); AISIN SEIKI KABUSHIKI KAISHA, Kariya (JP)

( * ) Notice: Subject to any disclaimer, the term of this patent is extended or adjusted under 35 U.S.C. 154(b) by 88 days.

(21) Appl. No.: 16/660,211

(22) Filed: Oct. 22, 2019

(65) Prior Publication Data

US 2020/0157999 A1 May 21, 2020

(30) Foreign Application Priority Data

Nov. 19, 2018 (JP) ..... JP2018-216159

(51) Int. Cl.
*F01P 7/14* (2006.01)
*F01P 3/18* (2006.01)
(Continued)

(52) U.S. Cl.
CPC *F01P 7/14* (2013.01); *F01P 3/18* (2013.01); *F01P 5/10* (2013.01); *F01P 7/167* (2013.01);
(Continued)

(58) Field of Classification Search
CPC ..... F01P 7/162; F01P 7/164; F01P 2007/146; F16K 15/033
See application file for complete search history.

(56) References Cited

U.S. PATENT DOCUMENTS 4,423,705 A * 1/1984 Morita ..... F01P 5/12 123/41.02
5,975,031 A * 11/1999 Bartolazzi ..... F01P 7/164 123/41.02
(Continued)

FOREIGN PATENT DOCUMENTS

DE 198 31 901 A1 1/2000
DE 202011002336 U1 6/2011
(Continued)

OTHER PUBLICATIONS

English machine translation of description for DE 202011002336 U1 provided by ESPACENET (Year: 2021).*
(Continued)

*Primary Examiner* — Michael A Kessler
(74) *Attorney, Agent, or Firm* — Oliff PLC

(57) ABSTRACT

A cooling apparatus for an internal combustion engine includes a pump, a radiator, a flow rate adjustment valve, a bypass passage, and a controller. The flow rate adjustment valve includes a valve member that rotates to change an open degree of the flow rate adjustment valve and a valve member biasing component that biases the valve member in a valve-closing direction in which the open degree decreases. The valve member rotates in a valve-opening direction in which the open degree increases when a pressure difference increases between positions upstream and downstream of the valve member in a flow direction of coolant in the circulation circuit and rotate in the valve-closing direction when the pressure difference decreases. The controller increases the pump discharge amount as a
(Continued)

target radiator flow rate that is a target of an amount of coolant passing through the radiator increases.

6 Claims, 7 Drawing Sheets

(51) Int. Cl.
*F01P 5/10* (2006.01)
*F01P 7/16* (2006.01)

(52) U.S. Cl.
CPC ... *F01P 2007/143* (2013.01); *F01P 2007/146* (2013.01); *F01P 2023/08* (2013.01)

(56) References Cited

U.S. PATENT DOCUMENTS

| | | | | |
|---|---|---|---|---|
| 6,152,088 | A | 11/2000 | Occella et al. | |
| 8,408,168 | B2 * | 4/2013 | Suzuki | F01P 7/164 123/41.44 |
| 8,695,542 | B2 * | 4/2014 | Vacca | F01P 7/165 123/41.15 |
| 9,109,497 | B2 | 8/2015 | Matsusaka et al. | |
| 9,243,545 | B2 | 1/2016 | Quix | |
| 9,500,115 | B2 | 11/2016 | Quix et al. | |
| 10,337,389 | B2 | 7/2019 | Quix | |
| 2003/0136357 | A1 | 7/2003 | Kobayashi et al. | |
| 2004/0035194 | A1 * | 2/2004 | Wakahara | F01P 11/16 73/114.71 |
| 2006/0005789 | A1 | 1/2006 | Miura et al. | |
| 2010/0050960 | A1 * | 3/2010 | Araki | F01P 7/165 123/41.1 |
| 2010/0083916 | A1 * | 4/2010 | Shintani | F01P 7/164 123/41.1 |
| 2010/0212612 | A1 | 8/2010 | Vacca et al. | |
| 2012/0103283 | A1 | 5/2012 | Mehring et al. | |
| 2012/0266828 | A1 * | 10/2012 | Araki | F01P 7/164 123/41.08 |
| 2013/0020513 | A1 | 1/2013 | Matsusaka et al. | |
| 2014/0007824 | A1 | 1/2014 | Hayashi et al. | |
| 2014/0137817 | A1 | 5/2014 | Komuro et al. | |
| 2016/0348567 | A1 * | 12/2016 | Watanabe | F01P 7/167 |
| 2016/0376977 | A1 | 12/2016 | Watanabe | |
| 2020/0158000 | A1 * | 5/2020 | Yoshida | F01P 7/164 |
| 2020/0158254 | A1 * | 5/2020 | Takagi | F01P 7/164 |

FOREIGN PATENT DOCUMENTS

| | | | | |
|---|---|---|---|---|
| EP | 2 876 274 | A1 | | 5/2015 |
| JP | 56019116 | A | * | 2/1981 |
| JP | 06142225 | A | * | 5/1994 |
| JP | 2006-029113 | A | | 2/2006 |
| JP | 2006-090226 | A | | 4/2006 |
| JP | 2015-124768 | A | | 7/2015 |
| JP | 6225949 | B2 | | 11/2017 |
| WO | 00/04283 | A1 | | 1/2000 |

OTHER PUBLICATIONS

Apr. 13, 2021 Office Action issued in U.S. Appl. No. 16/660,146.
Jun. 4, 2021 Notice of Allowance issued in U.S. Appl. No. 16/660,146.
Sep. 16, 2021 Corrected Notice of Allowability issued in U.S. Appl. No. 16/660,146.

* cited by examiner

COOLING APPARATUS FOR INTERNAL COMBUSTION ENGINE

FIELD

The following description relates to a cooling apparatus for an internal combustion engine including a radiator.

DESCRIPTION OF RELATED ART

Japanese Laid-Open Patent Publication No. 2006-29113 discloses an example of a cooling apparatus, which includes a circulation circuit for coolant flowing through both the cylinder block and the cylinder head of the internal combustion engine. The circulation circuit includes a pump and a radiator, which is arranged in series with the pump. The circulation circuit further includes a bypass passage. Coolant that has flowed through the cylinder block and the cylinder head flows through the bypass passage so as to bypass the radiator. In such a circulation circuit, the coolant that has passed through the radiator and the coolant that has flowed through the bypass passage are both supplied to the pump and then discharged out of the pump.

In the cooling apparatus, the portion of the circulation circuit where the coolant that has passed through the radiator merges with the coolant that has flowed through the bypass passage is provided with a flow rate adjustment valve. The flow rate adjustment valve includes a first valve member, which adjusts the amount of coolant passing through the radiator, a second valve member, which adjusts the amount of coolant passing through the bypass passage, and a single actuator, which is driven to move the first valve member and the second valve member. Moving the first valve member and the second valve member through control of the actuator adjusts the temperature of coolant circulating in the circulation circuit and the amount of coolant flowing through the circulation circuit.

The flow rate adjustment valve includes the actuator that adjusts the radiator flow rate.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A cooling apparatus for an internal combustion engine according to one aspect includes a circulation circuit for coolant in the internal combustion engine, a pump arranged on the circulation circuit, the pump being configured to change a discharge amount of coolant, a radiator and a flow rate adjustment valve arranged on the circulation circuit in series with the pump, and a bypass passage arranged on the circulation circuit. Coolant that has flowed through a cylinder block and a cylinder head of the internal combustion engine flows through the bypass passage so as to bypass the radiator and the flow rate adjustment valve. The cooling apparatus also includes a controller configured to control a pump discharge amount that is a discharge amount of coolant in the pump. The flow rate adjustment valve includes a valve member configured to rotate to change an open degree of the flow rate adjustment valve and a valve member biasing component configured to bias the valve member in a valve-closing direction that is a rotation direction in which the open degree decreases. The valve member is configured to rotate in a valve-opening direction that is a rotation direction in which the open degree increases when a pressure difference increases between a position upstream of the valve member and a position downstream of the valve member in a flow direction of coolant in the circulation circuit and rotate in the valve-closing direction when the pressure difference decreases. The controller is configured to increase the pump discharge amount as a target radiator flow rate that is a target of an amount of coolant passing through the radiator increases.

When the pump discharge amount increases, the pressure difference increases at the position downstream of the valve member and the position upstream of the valve member in the flow direction of coolant in the circulation circuit. This rotates the valve member in the valve-opening direction against a biasing force of the valve member biasing component, thereby increasing the open degree of the flow rate adjustment valve. In contrast, when the pressure difference decreases, the pressure difference decreases. This rotates the valve member in the valve-closing direction with a biasing force of the valve member biasing component, thereby decreasing the open degree of the flow rate adjustment valve.

In the above-described configuration, as the target radiator flow rate increases, the pump discharge amount increases. When the pump discharge amount increases as the target radiator flow rate increases, the pressure difference increases. This rotates the valve member in the valve-opening direction against the biasing force of the valve member biasing component, thereby increasing the open degree of the flow rate adjustment valve. As a result, the radiator flow rate increases. In contrast, when the pump discharge amount decreases as the target radiator flow rate decreases, the pressure difference decreases. This rotates the valve member in the valve-closing direction with the biasing force of the valve member biasing component, thereby decreasing the open degree of the flow rate adjustment valve. As a result, the radiator flow rate decreases. That is, the radiator flow rate can be changed in accordance with a change in the target radiator flow rate by changing the pump discharge amount in accordance with a change in the target radiator flow rate. Thus, even if the flow rate adjustment valve does not include a dedicated actuator that adjusts the rotation angle of the valve member, the open degree of the flow rate adjustment valve and the radiator flow rate RFR can be adjusted.

The above-described cooling apparatus includes a memory configured to store, when the open degree changes as the pump discharge amount changes, a map indicating a relationship between a radiator flow rate that is an amount of coolant passing through the radiator and a circulation coolant amount that is an amount of coolant circulating in the internal combustion engine. The cooling apparatus is configured to control the circulation coolant amount and the radiator flow rate through control of the pump discharge amount by the controller based on the target radiator flow rate and a target circulation coolant amount that is a target of the circulation coolant amount. The map indicates the relationship in which the circulation coolant amount is larger when the radiator flow rate is large than when the radiator flow rate is small. When the target radiator flow rate is input to the map, the circulation coolant amount that is output from the relationship indicated on the map is defined as a reference circulation coolant amount. The controller is configured to set the pump discharge amount to a value corresponding to the target circulation coolant amount when the target circulation coolant amount is equal to the reference circulation coolant amount.

When the target radiator flow rate is input to the map, the circulation coolant amount that is output from the relationship indicated on the map is defined as a reference circulation coolant amount. In this case, the controller is configured to set the pump discharge amount to a value corresponding to the target circulation coolant amount when the target circulation coolant amount is equal to the reference circulation coolant amount.

When the pump discharge amount increases, the amount of coolant discharged from the pump increases. This increases the circulation coolant amount. That is, the pump discharge amount correlates with the circulation coolant amount. Thus, when the pump discharge amount increases as the target circulation coolant amount increases, a change in the circulation coolant amount can follow a change in the target circulation coolant amount.

Further, when the open degree of the flow rate adjustment valve changes as the pump discharge amount changes, the radiator flow rate can be controlled by adjusting the open degree through the control of the pump discharge amount. Thus, when the target circulation coolant amount is equal to the reference circulation coolant amount calculated from the target radiator flow rate using the above-described map, the radiator flow rate can be matched to the target circulation coolant amount by setting the pump discharge amount to a value corresponding to the target circulation coolant amount.

Thus, the radiator flow rate and the circulation coolant amount can be controlled in correspondence with the target circulation coolant amount and the target circulation coolant amount by setting the pump discharge amount to a value corresponding to the target circulation coolant amount when the target circulation coolant amount is equal to the reference circulation coolant amount like in the above-described configuration.

In contrast, when the target circulation coolant amount is less than the reference circulation coolant amount, the radiator flow rate falls below the target circulation coolant amount even if the pump discharge amount is set to a value corresponding to the target circulation coolant amount. In the above-described configuration, the controller may be configured to set the pump discharge amount to a value corresponding to the reference circulation coolant amount when the target circulation coolant amount is less than the reference circulation coolant amount. In this configuration, although the circulation coolant amount is larger than the target circulation coolant amount, the radiator flow rate can be approximated to the target circulation coolant amount as compared to when the pump discharge amount is set to a value corresponding to the target circulation coolant amount.

In the above-described cooling apparatus, the flow rate adjustment valve includes a stopper that moves between a restriction position at which the stopper engages with the valve member to restrict rotation of the valve member and a retraction position at which the stopper does not engage with the valve member and the rotation of the valve member is permitted. In this cooling apparatus, the controller is configured to execute, when maintaining the open degree, a preparatory process of moving the stopper to the restriction position after arranging the stopper at the retraction position and controlling the pump discharge amount to arrange the valve member further in the valve-closing direction than the stopper.

In the above-described configuration, to maintain the open degree of the flow rate adjustment valve, the preparatory process is executed. Upon the execution of the preparatory process, the stopper is arranged at the retraction position, and the valve member is arranged further in the valve-closing direction than the stopper. This moves the stopper to the restriction position. At the point in time the preparatory process ends, the valve member is arranged in the valve-closing direction than the stopper, and the stopper is arranged at the restriction position. Thus, in this state, when the pump discharge amount increases and the pressure difference increases at the position upstream of the valve member and the position downstream of the valve member, the valve member engages with the stopper even if the valve member rotates in the valve member. This restricts further rotation of the valve member in the valve-opening direction and consequently maintains the open degree of the flow rate adjustment valve. When the valve member is engaged with the stopper in such a manner, the rotation angle of the valve member (i.e., the open degree of the flow rate adjustment valve) cannot be kept even if the pump discharge amount increases.

In the above-described cooling apparatus, the controller is configured to alternately repeat a maintaining period and an open degree adjustment period when the target circulation coolant amount is larger than the reference circulation coolant amount. In the maintaining period, the open degree is maintained by arranging the valve member further in the valve-closing direction than the stopper, arranging the stopper at the restriction position, and then setting the pump discharge amount to a value corresponding to the target circulation coolant amount. In the open degree adjustment period, the pump discharge amount is set to a value corresponding to the target circulation coolant amount by cancelling engagement of the stopper with the valve member and permitting the rotation of the valve member in the valve-closing direction.

During the maintaining period, the pump discharge amount is controlled to a value corresponding to the target circulation coolant amount, and the open degree of the flow rate adjustment valve is kept. Thus, although a deviation between the circulation coolant amount and the target circulation coolant amount can be reduced, the radiator flow rate falls below the target circulation coolant amount. During the open degree adjustment period, the rotation of the valve member in the valve-opening direction is permitted, and the pump discharge amount is controlled to a value corresponding to the target circulation coolant amount. Thus, the rotation angle of the valve member is larger in the open degree adjustment period than in the maintaining period. That is, the open degree is larger in the open degree adjustment period than in the maintaining period. Thus, although a deviation between the circulation coolant amount and the target circulation coolant amount can be reduced, the radiator flow rate exceeds the target circulation coolant amount.

In the above-described configuration, when the target circulation coolant amount is larger than the reference circulation coolant amount, the maintaining period and the open degree adjustment period are alternately repeated. This allows the average value of the radiator flow rate to approximate to the target circulation coolant amount during the repetition period while limiting a deviation between the circulation coolant amount and the target circulation coolant amount.

In the above-described cooling apparatus, the controller is configured to decrease, when the target circulation coolant amount is larger than the reference circulation coolant amount, a proportion of the open degree adjustment period during a period in which the maintaining period and the open degree adjustment period are alternately repeated as a difference between the target circulation coolant amount and the reference circulation coolant amount increases.

In this manner, the difference between the target circulation coolant amount and the reference circulation coolant amount is used to adjust the proportion of the open degree adjustment period in the repetition period.

Further, the controller may be configured to maintain a state in which the rotation of the valve member in the valve-opening direction is restricted by arranging the stopper at the restriction position to engage the stopper with the valve member when a warm-up operation of the internal combustion engine is not complete. In this configuration, when the warm-up operation of the internal combustion engine is incomplete, the open degree of the flow rate adjustment valve is maintained. Maintaining the open degree in such a manner limits an increase in the radiator flow rate. This increases the temperature of coolant at an early stage.

The controller may be configured to permit the rotation of the valve member in the valve-opening direction and control the pump discharge amount based on the target radiator flow rate when the warm-up operation of the internal combustion engine is complete. In this configuration, when the warm-up operation of the internal combustion engine is complete, the radiator flow rate can be maintained by controlling the pump discharge amount based on the target radiator flow rate. That is, the temperature and the circulation amount of coolant flowing through the circulation circuit can be properly adjusted.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A cooling apparatus 20 for an internal combustion engine 10 according to an embodiment will now be described with reference to FIGS. 1 to 11.

Figure 1:
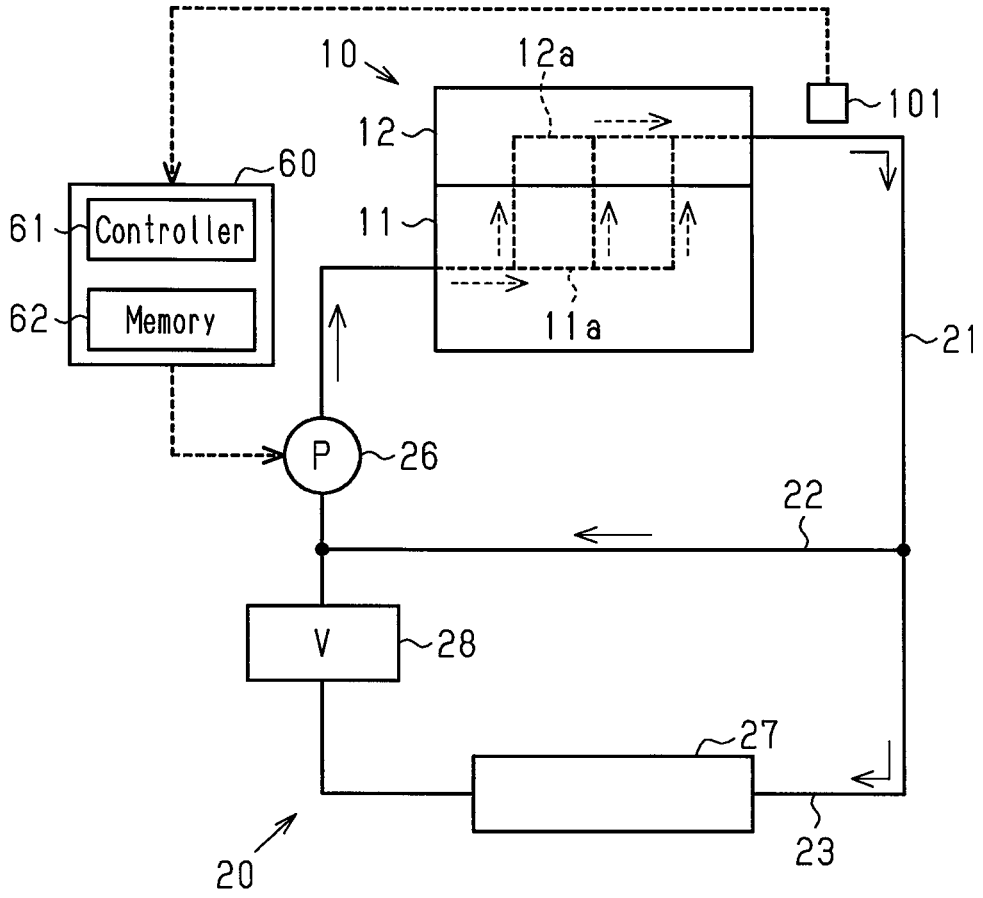
FIG. 1 is a schematic diagram showing a cooling apparatus for an internal combustion engine according to an embodiment.

As shown in FIG. 1, the cooling apparatus 20 includes a circulation circuit 21, through which coolant flows. The coolant flows through a water jacket 11*a* in a cylinder block 11 of the internal combustion engine 10 and through a water jacket 12*a* in a cylinder head 12. The circulation circuit 21 is provided with an electric pump 26, which discharges coolant toward the water jacket 11*a* in the cylinder block 11. The circulation circuit 21 includes a radiator 27 and a flow rate adjustment valve 28, which are arranged in series with the pump 26. The flow rate adjustment valve 28 is configured to adjust a radiator flow rate RFR, which is the amount of coolant passing through the radiator 27, and is arranged between the radiator 27 and the pump 26. Further, the circulation circuit 21 includes a bypass passage 22. Coolant flows through the bypass passage 22 so as to bypass the radiator 27 and the flow rate adjustment valve 28.

In FIG. 1, the flow of coolant in the water jacket 11*a* of the cylinder block 11 and the water jacket 12*a* of the cylinder head 12 is shown by the broken arrows. Further, the flow of coolant flowing from the pump 26 toward the cylinder block 11 and the flow of coolant that has been discharged out of the cylinder head 12 are shown by the solid arrows.

The circulation circuit 21 includes a radiator passage 23, which is arranged in parallel to the bypass passage 22. The radiator passage 23 is a coolant-flowing passage including the radiator 27 and the flow rate adjustment valve 28. Coolant passing through the radiator passage 23 and drawn into the pump 26 is cooled by the radiator 27. In contrast, coolant passing through the bypass passage 22 and drawn into the pump 26 is not cooled by the radiator 27. Thus, the temperature of the coolant drawn into the pump 26 through the bypass passage 22 is higher than the temperature of the coolant drawn into the pump 26 through the radiator passage 23.

The flow rate adjustment valve 28 will now be described with reference to FIGS. 2 to 5.

The flow rate adjustment valve 28 includes a tubular housing 30. Coolant that has passed through the radiator 27 flows through the housing 30 in a direction indicated by the white arrows. The housing 30 includes a rotation shaft 32, which is supported by the housing 30, and a valve member 33, which rotates about the rotation shaft 32. The valve member 33 is rotationally supported by the rotation shaft 32. The housing 30 includes a valve accommodation portion 31, which is part of the radiator passage 23 and accommodates the valve member 33.

When the valve member 33 rotates to change the rotation angle of the valve member 33, an open degree V of the flow rate adjustment valve 28 changes. The pressure difference between the upstream side and the downstream side of the valve member 33 in the radiator passage 23 is defined as a valve member pressure difference ΔPV. The upstream side of the valve member 33 refers to the left side of the valve member 33, which is closer to the radiator 27, in FIGS. 2 to 5. The downstream side of the valve member 33 refers to the right side of the valve member 33, which is closer to the pump 26, in FIGS. 2 to 5. In this case, when the valve member pressure difference ΔPV increases, the valve member 33 rotates in a direction in which the open degree V of the flow rate adjustment valve 28 increases. This rotation direction of the valve member 33 is defined as a valve-opening direction C1. The rotation direction of the valve member 33 opposite to the valve-opening direction C1 in a direction in which the open degree V decreases is defined as a valve-closing direction C2.

In the present embodiment, the valve member pressure difference ΔPV can be adjusted by controlling a pump drive amount DP, which is a drive amount of the pump 26. More specifically, as the pump drive amount DP increases, the amount of coolant discharged from the pump 26 increases. That is, the pump drive amount DP is a value corresponding to a pump discharge amount, which is the discharge amount of coolant in the pump 26. As the discharge amount of coolant increases, the upstream pressure of the valve member 33 increases in the radiator passage 23. This increases the valve member pressure difference ΔPV.

The flow rate adjustment valve 28 includes a restriction portion 34, which restricts rotation of the valve member 33 in the valve-closing direction C2. The restriction portion 34 restricts rotation of the valve member 33 in the valve-closing direction C2 by engaging the upstream surface of the valve member 33. In the present embodiment, when the open degree V becomes the minimum, the valve member 33 and the restriction portion 34 engage with each other. The open degree V obtained when the rotation of the valve member 33 in the valve-closing direction C2 is restricted by the restriction portion 34 in this manner is defined as a set open degree VA.

Figure 2:
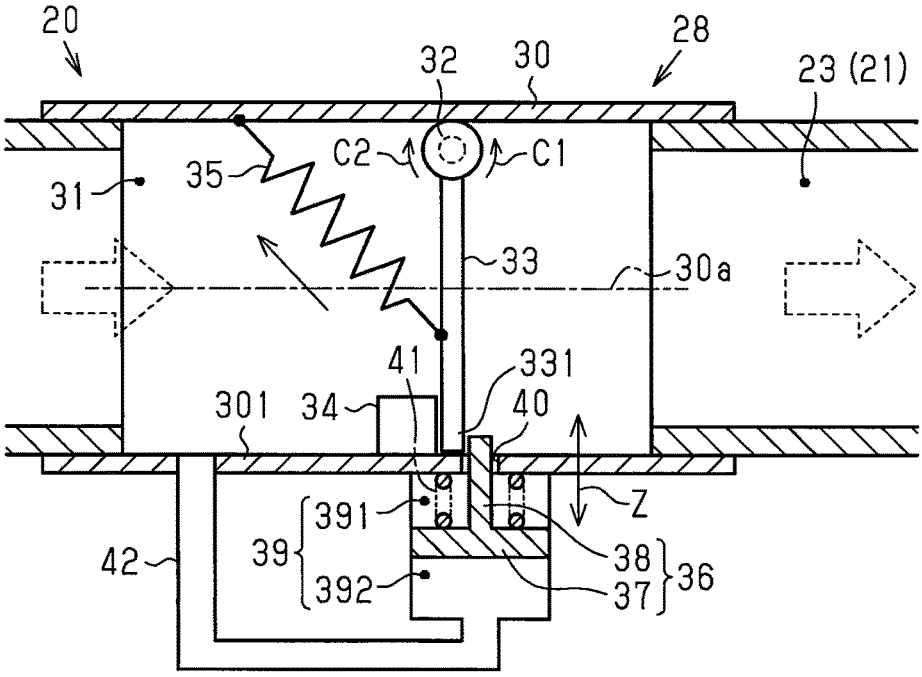
FIG. 2 is a cross-sectional view schematically showing the flow rate adjustment valve of the cooling apparatus.

The flow rate adjustment valve 28 includes a valve member biasing component 35, which biases the valve member 33 in the valve-closing direction C2 as shown by the solid arrow in FIG. 2. Thus, when the valve member pressure difference ΔPV increases, the valve member 33 rotates in the valve-opening direction C1 against a biasing force of the valve member biasing component 35. In contrast, when the valve member pressure difference ΔPV decreases, the valve member 33 rotates in the valve-closing direction C2 against a biasing force of the valve member biasing component 35. When the valve member pressure difference ΔPV decreases in this manner to reach a set pressure difference ΔPVA, the valve member 33 and the restriction portion 34 engage with each other. That is, when the valve member pressure difference ΔPV is less than or equal to the set pressure difference ΔPVA, the open degree V of the flow rate adjustment valve 28 is maintained at the set open degree VA.

Figure 3:
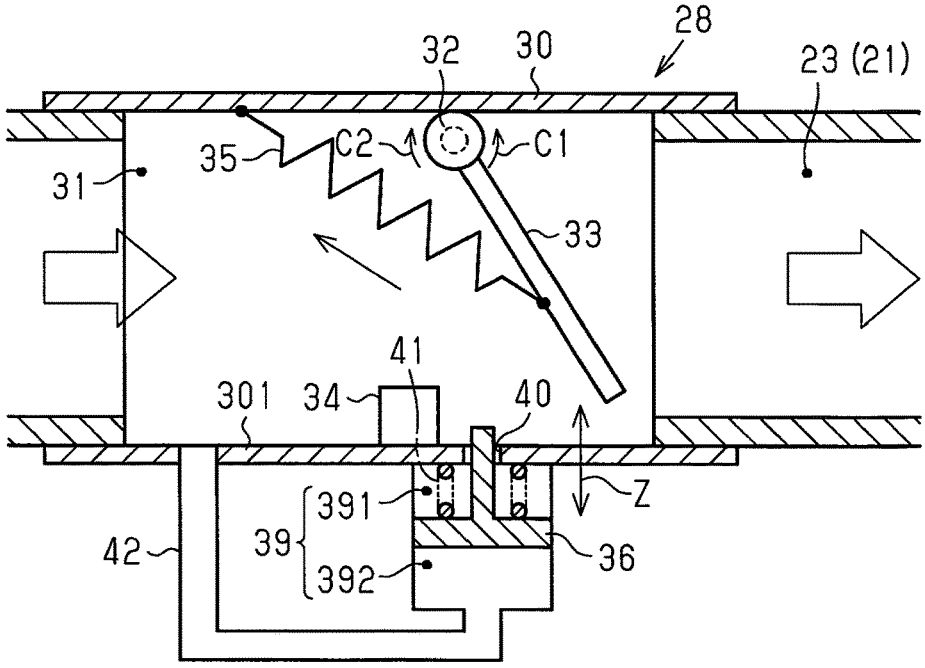
FIG. 3 is a cross-sectional view schematically showing the flow rate adjustment valve.
Figure 4:
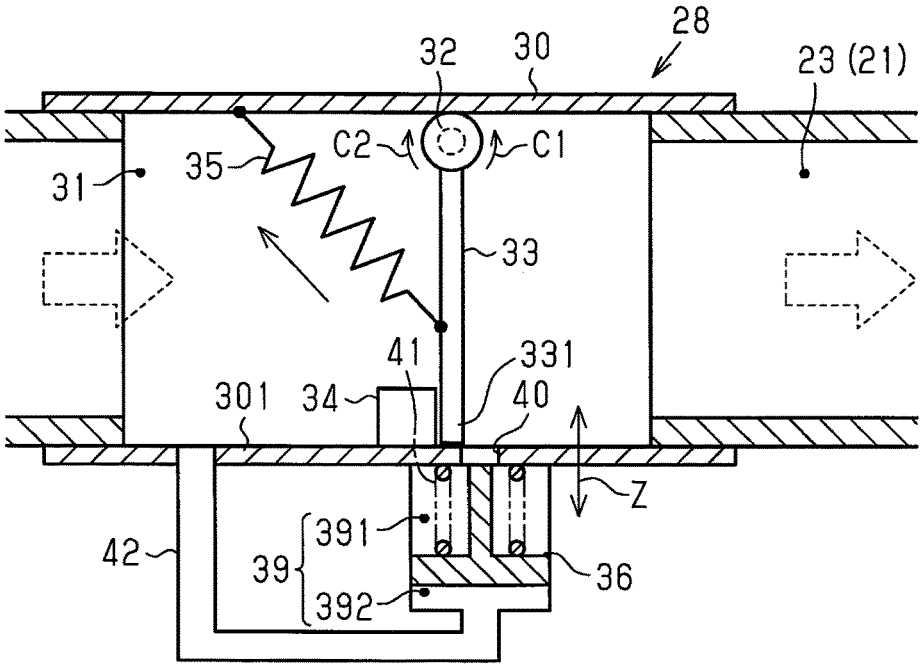
FIG. 4 is a cross-sectional view schematically showing the flow rate adjustment valve.

Further, a stopper 36 is arranged downstream of the restriction portion 34 in a direction in which coolant flows in the radiator passage 23, that is, arranged between the restriction portion 34 and the pump 26. The stopper 36 moves between a restriction position, where the stopper 36 engages with the valve member 33 to restrict rotation of the valve member 33, and a retraction position, where the stopper 36 does not engage with the valve member 33 and the rotation of the valve member 33 is permitted. The restriction position refers to the position of the stopper 36 shown in FIGS. 2 and 3. The retraction position refers to the position of the stopper 36 shown in FIG. 4. As shown in FIG. 2, when the stopper 36 located at the restriction position engages with the downstream surface of a distal end 331 of the valve member 33, further rotation of the valve member 33 in the valve-opening direction C1 is restricted by the stopper 36 to maintain the open degree V of the flow rate adjustment valve 28. However, even if the stopper 36 is located at the restriction position as shown in FIG. 3, when the distal end 331 of the valve-opening direction C1 is located further in the valve-opening direction C1 than the restriction position, rotation of the valve member 33 in the valve-opening direction C1 is not restricted by the stopper 36. When the stopper 36 is located at the retraction position, the stopper 36 does not engage with the valve member 33 as shown in FIG. 4. That is, the rotation of the valve member 33 is not restricted by the stopper 36.

The flow rate adjustment valve 28 includes a stopper accommodation chamber 39, which is capable of accommodating the stopper 36. The stopper accommodation chamber 39 and the valve accommodation portion 31 are separated from each other by a side wall 301 of the housing 30. That is, the side wall 301 of the housing 30 is a partition wall. As shown by the long dashed double-short dashed line in FIG. 2, the stopper accommodation chamber 39 is located on the opposite side of a central axis 30*a* of the housing 30 from the rotation shaft 32. The side wall 301 of the housing 30 has an insertion portion 40, which connects the stopper accommodation chamber 39 and the valve accommodation portion 31 to each other. The stopper 36 is inserted through the insertion portion 40.

As shown in FIG. 2, the movement direction of the stopper 36 is defined as a stopper movement direction Z. The stopper 36 is located in the stopper accommodation chamber 39. The stopper 36 includes a base 37, which divides the stopper accommodation chamber 39 into two regions 391 and 392. The stopper 36 also includes a protrusion 38, which protrudes from the base 37. One of the two regions 391 and 392 that is connected to the insertion portion 40 is defined as a first region 391, and the region that differs from the first region 391 is defined as a second region 392. The first region 391 and the second region 392 are laid out in the stopper movement direction Z. The first region 391 is located between the second region 392 and the valve accommodation portion 31 in the stopper movement direction Z.

The protrusion 38 protrudes from the base 37 into the first region 391. The protrusion 38 is inserted through the insertion portion 40 when the stopper 36 moves between the retraction position and the restriction position. When the stopper 36 is located at the restriction position, the protrusion 38 is located in the valve accommodation portion 31 as shown in FIGS. 2 and 3 and is thus engageable with the distal end 331 of the valve member 33. When the stopper 36 is moved from the restriction position to the retraction position, the protrusion 38 of the stopper 36 is moved out of the valve accommodation portion 31 through the insertion portion 40 as shown in FIG. 4.

The flow rate adjustment valve 28 includes a stopper biasing component 41, which biases the stopper 36 toward the retraction position. That is, the stopper biasing component 41 biases the stopper 36 in a direction in which the volume of the first region 391 increases and the volume of the second region 392 decreases. The biasing force of the stopper biasing component 41 is smaller than the biasing force of the valve member biasing component 35. The stopper biasing component 41 is located in the first region 391 of the stopper accommodation chamber 39.

Figure 5:
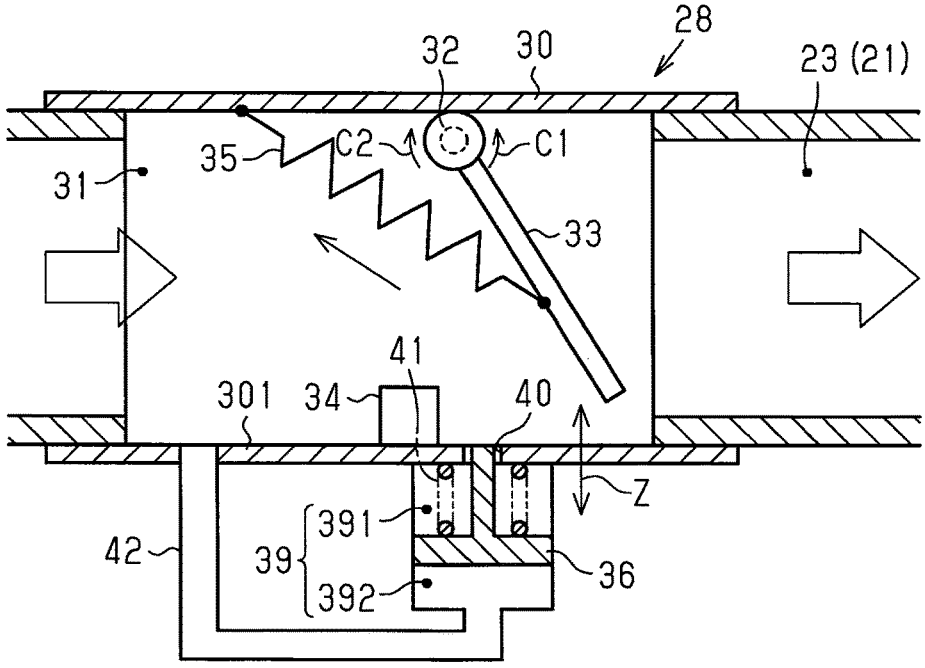
FIG. 5 is a cross-sectional view schematically showing the flow rate adjustment valve.

The flow rate adjustment valve 28 includes a connection passage 42, which connects the second region 392 of the stopper accommodation chamber 39 to the space of the radiator passage 23 between the valve member 33 and the radiator 27. Even when the stopper 36 is located at the retraction position as shown in FIGS. 4 and 5, the connection passage 42 is connected to the second region 392.

As the upstream pressure of the valve member 33 in the radiator passage 23 increases, the pressures of the connection passage 42 and the second region 392 increase. This increases the pressure difference between the second region 392 and the first region 391. Thus, the stopper 36 can be moved in the direction in which the pressure of the second region 392 increases against the biasing force of the stopper biasing component 41. More specifically, when the pressure in the connection passage 42 and the pressure in the second region 392 are less than or equal to a first pressure Pa1, the stopper 36 is maintained at the retraction position by the biasing force of the stopper biasing component 41. When the pressure in the connection passage 42 and the pressure in the second region 392 change from the first pressure Pa1 or lower to a pressure higher than the first pressure Pa1, the stopper 36 moves toward the restriction position against the biasing force of the stopper biasing component 41. When the pressure in the connection passage 42 and the pressure in the second region 392 increase to be greater than or equal to a second pressure Pa2, which is higher than the first pressure Pa1, the stopper 36 reaches the restriction position and is maintained at the restriction position.

Next, the control configuration of the cooling apparatus 20 will be described with reference to FIGS. 1 and 6.

As shown in FIG. 1, the cooling apparatus 20 includes a control device 60. The control device 60 receives detection signals from various sensors such as a water temperature sensor 101. The water temperature sensor 101 detects an outlet water temperature Twt, which is the temperature of coolant that has flowed out of the cylinder head 12, and outputs a signal corresponding to the detected outlet water temperature Twt as a detection signal. The control device 60 is configured to control driving of the pump 26 based on the detection signals of the various sensors including the water temperature sensor 101.

The control device 60 includes a controller 61 and a memory 62. The controller 61 is configured to control the outlet water temperature Twt by controlling the pump drive amount DP, which is a drive amount of the pump 26. As described above, the pump drive amount DP correlates with the pump discharge amount. Thus, in other words, the controller 61 controls the pump discharge amount.

The memory 62 stores two types of lines, namely, a first line MP1 and a second line MP2. The first line MP1 and the second line MP2 indicate the relationship between a circulation coolant amount CR and a radiator flow rate RFR. The first line MP1 of the two lines MP1 and MP2 indicates the relationship between the circulation coolant amount CR and the radiator flow rate RFR when the open degree V of the flow rate adjustment valve 28 changes as the pump drive amount DP changes. The second line MP2 of the two lines MP1 and MP2 differs from the first line MP1. The second line MP2 indicates the relationship between the circulation coolant amount CR and the radiator flow rate RFR when rotation of the valve member 33 in the valve-opening direction C1 is restricted by the stopper 36, that is, when the open degree V is maintained.

The lines MP1 and MP2, which are stored in the memory 62, will now be described with reference to FIG. 6. In FIG. 6, the first line MP1 is represented by the solid line, and the second line MP2 is represented by the broken line.

Figure 6:
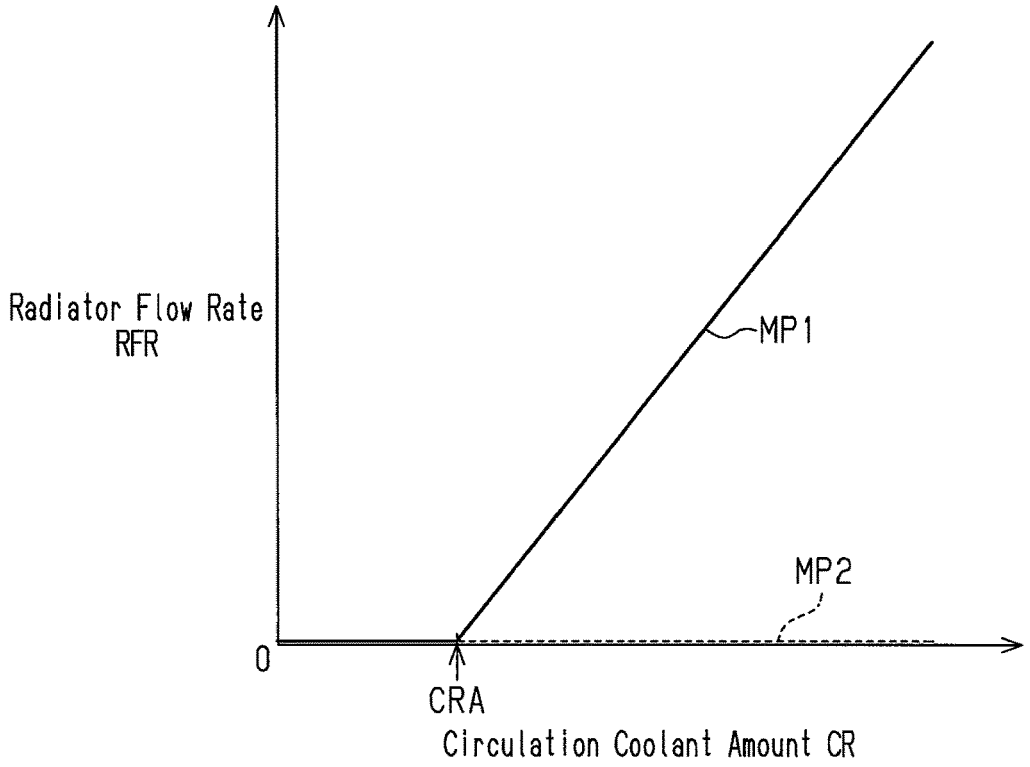
FIG. 6 is a map illustrating the relationship between a radiator flow rate and a circulation coolant amount.

As shown by the broken line in FIG. 6, in the second line MP2, the radiator flow rate RFR is maintained at a set flow rate such as 0 regardless of the circulation coolant amount CR.

As shown by the solid line in FIG. 6, in the first line MP1, the radiator flow rate RFR is maintained at the set flow rate when the circulation coolant amount CR is less than a switch coolant amount CRA. This is because when the circulation coolant amount CR is less than the switch coolant amount CRA, the open degree V of the flow rate adjustment valve 28 is maintained at the set open degree VA by the biasing force of the valve member biasing component 35. When the circulation coolant amount CR is greater than or equal to the switch coolant amount CRA, the radiator flow rate RFR increases as the circulation coolant amount CR increases. This is because when the circulation coolant amount CR is greater than or equal to the switch coolant amount CRA, the valve member 33 rotates in the valve-opening direction C1 against the biasing force of the valve member biasing component 35 to increase the open degree V as the circulation coolant amount CR increases. Thus, the first line MP1 indicates a relationship in which the circulation coolant amount CR is larger when the radiator flow rate RFR is large than when the radiator flow rate RFR is small.

As the pump drive amount DP increases, the circulation coolant amount CR increases. As the circulation coolant amount CR increases, the upstream pressure of the valve member 33 in the radiator passage 23 increases, that is, the valve member pressure difference ΔPV increases. That is, the valve member pressure difference ΔPV correlates with the circulation coolant amount CR. Thus, the switch coolant amount CRA is equal to the circulation coolant amount CR obtained when the valve member pressure difference ΔPV matches the set pressure difference ΔPVA.

The set pressure difference ΔPVA is smaller when a biasing component with a large biasing force is employed as the valve member biasing component 35 than when a biasing component with a small biasing force is employed as the valve member biasing component 35. That is, the switch coolant amount CRA is a value that correlates with the biasing force of the valve member biasing component 35.

As the circulation coolant amount CR increases, increases in the outlet water temperature Twt become less likely. Further, as the proportion of a partial amount of coolant cooled by the radiator 27 increases in the total amount of coolant discharged out of the pump 26, increases in the outlet water temperature Twt become less likely. Thus, when the outlet water temperature Twt is controlled, a target radiator flow rate amount RFRTr, which is the target of the radiator flow rate RFR, and a target circulation coolant amount CRTr, which is the target of the circulation coolant amount CR, are calculated such that the outlet water temperature Twt becomes a range within an allowable range.

The controller 61 controls the pump drive amount DP based on the target radiator flow rate amount RFRTr and the target circulation coolant amount CRTr.

Figure 7:
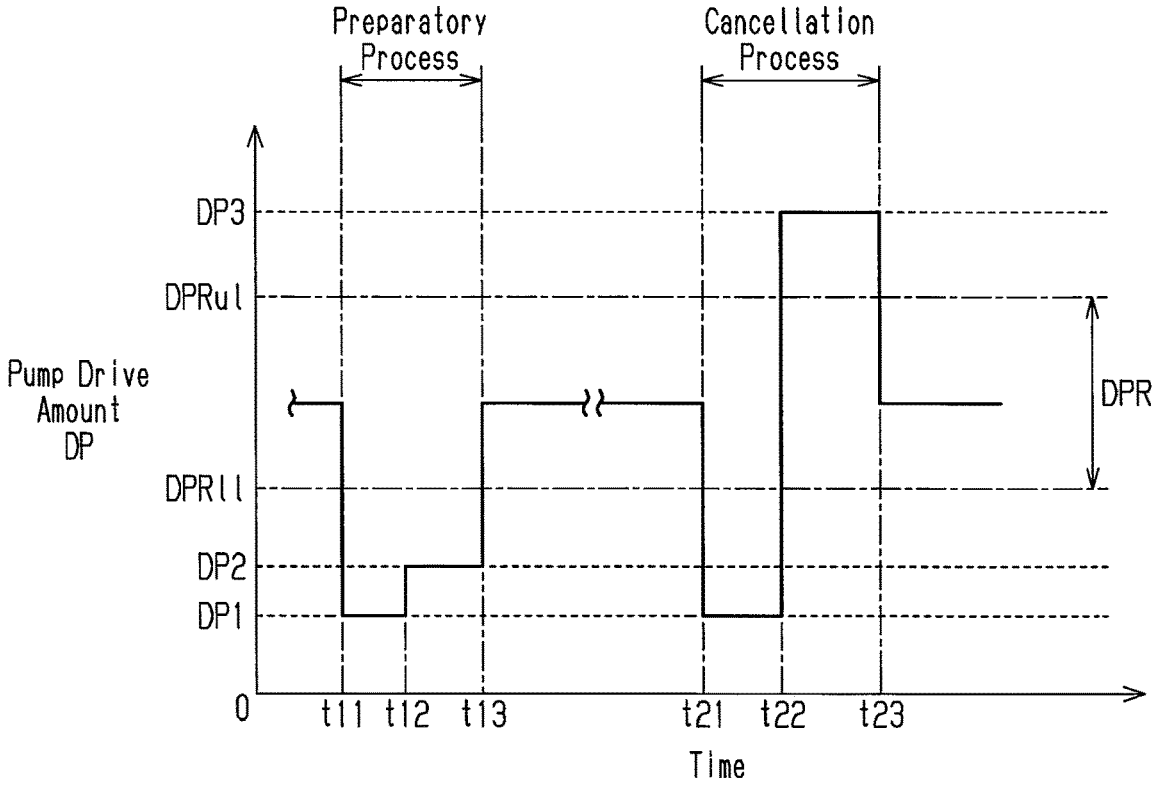
FIG. 7 is a timing diagram illustrating changes in a pump drive amount during execution of a preparatory process and changes in the pump drive amount during execution of a cancellation process.

The process performed by the controller 61 when a warm-up operation of the internal combustion engine 10 is not yet complete will now be described with reference to FIG. 7. FIG. 7 shows a normal drive region DPR, which refers to a region of the pump drive amount DP that may be set when rotation of the valve member 33 in the valve-opening direction C1 is not restricted by the stopper 36 and the open degree V can be adjusted by adjusting the pump drive amount DP.

When the outlet water temperature Twt is less than a determination water temperature TwtTh, the determination that the warm-up operation is complete is not been made. In such a case, the controller 61 maintains the open degree V of the flow rate adjustment valve 28. That is, when the determination that the warm-up operation is complete has not been made and the open degree V is not maintained, the controller 61 executes a preparatory process.

At the point in time t11, when the preparatory process is started, the controller 61 changes the pump drive amount DP to a first drive amount DP1. The first drive amount DP1 refers to a value that is smaller than a lower limit DPR ll of the normal drive region DPR. As the pump drive amount DP increases, the discharge amount of coolant of the pump 26 increases. As the discharge amount of coolant of the pump 26 increases, the circulation coolant amount CR increases. That is, the pump drive amount DP correlates with the circulation coolant amount CR. In the present embodiment, the first drive amount DP1 is set to a pump drive amount DP that allows the circulation coolant amount CR to be less than the switch coolant amount CRA.

Thus, when the pump drive amount DP is changed to the first drive amount DP1, the circulation coolant amount CR decreases. Accordingly, in the radiator passage 23, the upstream pressure of the valve member 33 decreases, that is, the valve member pressure difference ΔPV decreases. As the valve member pressure difference ΔPV decreases, the valve member 33 rotates in the valve-closing direction C2 against the biasing force of the valve member biasing component 35. When the circulation coolant amount CR is less than the switch coolant amount CRA and the valve member pressure difference ΔPV is less than or equal to the set pressure difference ΔPVA, the valve member 33 is located further in the valve-closing direction C2 than the stopper 36. This causes the restriction portion 34 to engage with the upstream surface of the distal end 331 of the valve member 33.

Further, when the upstream pressure of the valve member 33 in the radiator passage 23 decreases, the pressure in the connection passage 42 and the pressure in the second region 392 of the stopper accommodation chamber 39 are also decreased by changing the pump drive amount DP to the first drive amount DP1. As a result, the biasing force of the stopper biasing component 41 moves the stopper 36 from the restriction position toward the retraction position. When the upstream pressure of the valve member 33 in the radiator passage 23 decreases, the pressure in the connection passage 42 and the pressure in the second region 392 of the stopper accommodation chamber 39 decrease to the first pressure Pa1 or lower. This moves the stopper 36 to the retraction position. When the pressure in the connection passage 42 and the pressure in the second region 392 remain less than or equal to the first pressure Pa1, the stopper 36 is maintained at the retraction position.

As the pump drive amount DP decreases to a larger extent and the upstream pressure of the valve member 33 in the radiator passage 23 decreases to a larger extent, the valve member 33 rotates in the valve-closing direction C2 at a higher speed. In other words, as the pump drive amount DP decreases to a smaller extent and the upstream pressure of the valve member 33 in the radiator passage 23 decreases to a small extent, increases in the rotation speed of the valve member 33 in the valve-closing direction C2 become less likely.

In the present embodiment, when the pump drive amount DP is changed from a value within the normal drive region DPR to the first drive amount DP1, the upstream pressure of the valve member 33 in the radiator passage 23 decreases relatively gradually. This limits an increase in the rotation speed of the valve member 33 in the valve-closing direction C2. As a result, when the valve member 33 rotates in the valve-closing direction C2 due to a decrease in the valve member pressure difference ΔPV, the valve member 33 is located further in the valve-closing direction C2 than the stopper 36 after the stopper 36 moves to the retraction position.

At the point in time t12, the controller 61 determines that the stopper 36 is located at the retraction position and the valve member 33 is engaged with the restriction portion 34. Thus, the controller 61 changes the pump drive amount DP from the first drive amount DP1 to a second drive amount DP2. The second drive amount DP2 is larger than the first drive amount DP1.

The length of time between the point in time t11 and the point in time t12 is set to time for the valve member 33 and the restriction portion 34 to be engaged with each other by changing the pump drive amount DP to the first drive amount DP1, or time that is slightly longer than that time. As the pump drive amount DP prior to starting the preparatory process increases, the rotation angle of the valve member 33 prior to starting the preparatory process increases. Thus, the time for the valve member 33 and the restriction portion 34 to be engaged with each other is presumably long. Thus, the length of time from the point in time t11 to the point in time t12, that is, the length of time during which the pump drive amount DP is maintained at a value less than or equal to the first drive amount DP1, may be varied in accordance with the pump drive amount DP prior to starting the preparatory process.

As shown in FIG. 7, the second drive amount DP2 is larger than the first drive amount DP1. The second drive amount DP2 is set to a value that satisfies the following two conditions. In the present embodiment, the second drive amount DP2 is set to a value that is smaller than the lower limit DPR ll of the normal drive region DPR. However, as long as the following two conditions are satisfied, the second drive amount DP2 may be a value greater than or equal to the lower limit DPR ll.

(Condition 1) When the pump drive amount DP is set to the second drive amount DP2, the pressure in the connection passage 42 and the pressure in the second region 392 are set to the second pressure Pa2, which is higher than the first pressure Pa1, such that the stopper 36 can be arranged at the restriction position.

(Condition 2) When the pump drive amount DP is set to the second drive amount DP2, the circulation coolant amount CR is set to remain less than the switch coolant amount CRA such that the valve member 33 can be maintained at a position located further in the valve-closing direction C2 than the stopper 36.

Thus, at the point in time t12, when the pump drive amount DP is changed from the first drive amount DP1 to the second drive amount DP2, the stopper 36 moves from the retraction position to the restriction position with the valve member 33 located further in the valve-closing direction C2 than the stopper 36.

At the point in time t13, the controller 61 determines that the distal end 331 of the valve member 33 is located further in the valve-closing direction C2 than the stopper 36 and the stopper 36 is located at the restriction position. The length of time between the point in time t12 and the point in time t13 is set to time for the stopper 36 to be moved from the retraction position to the restriction position by setting the pump drive amount DP to the second drive amount DP2, or time that is slightly longer than that time. Thus, the controller 61 can determine as described above on the condition that the point in time has reached the point in time t13 after the pump drive amount DP was changed to the second drive amount DP2. At the point in time t13, the controller 61 ends the preparatory process.

Subsequent to the point in time t13, the pump drive amount DP is adjusted within a range of the normal drive region DPR. When the pump drive amount DP is increased from the second drive amount DP2 in such a manner, the downstream surface of the distal end 331 of the valve member 33 engages with the stopper 36 though the valve member 33 attempts to rotate in the valve-opening direction C1. This restricts rotation of the valve member 33 in the valve-opening direction C1 to maintain the open degree V of the flow rate adjustment valve 28.

Next, the process performed by the controller 61 when the warm-up operation of the internal combustion engine 10 is complete will be described with reference to FIG. 7.

When the outlet water temperature Twt is greater than or equal to the determination water temperature TwtTh, it is determined that the warm-up operation is complete. In such a case, the controller 61 cancels the state in which the open degree V of the flow rate adjustment valve 28 is maintained at the set open degree VA. That is, the controller 61 executes the cancellation process.

At the point in time t21, when starting the cancellation process, the controller 61 changes the pump drive amount DP to the first drive amount DP1. This decreases the pressure in the connection passage 42 and the pressure in the second region 392 of the stopper accommodation chamber 39 to the first pressure Pa1 or lower. As a result, the stopper 36 moves from the restriction position to the retraction position. That is, at the point in time t22 or shortly before the point in time t22, the state in which the stopper 36 can restrict rotation of the valve member 33 in the valve-opening direction C1 is cancelled.

At the point in time t22, the controller 61 changes the pump drive amount DP from the first drive amount DP1 to a third drive amount DP3. The third drive amount DP3 is larger than an upper limit DPRu1 of the normal drive region DPR. That is, the third drive amount DP3 is larger than the second drive amount DP2. Thus, the difference between the third drive amount DP3 and the first drive amount DP1 is larger than the difference between the second drive amount DP2 and the first drive amount DP1. The increase speed of the upstream pressure of the valve member 33 in the radiator passage 23 when the pump drive amount DP is changed from the first drive amount DP1 to the second drive amount DP2 like during the execution of the preparatory process is defined as a restriction increase speed. When the pump drive amount DP is changed from the first drive amount DP1 to the third drive amount DP3 as described above, the increase speed of the upstream pressure of the valve member 33 in the radiator passage 23 can be set to be larger than the restriction increase speed. Thus, the increase speed of the valve member pressure difference ΔPV in this case is larger than the increase speed when the pump drive amount DP is changed from the first drive amount DP1 to the second drive amount DP2. In this manner, as the increase speed of the valve member pressure difference ΔPV increases, the rotation speed of the valve member 33 in the valve-opening direction C1 increases. As a result, at the point in time t23 or shortly before the point in time t23, the valve member 33 can be arranged further in the valve-opening direction C1 than the stopper 36 before the stopper 36 moves to the restriction position.

At the point in time t23, the controller 61 determines that the valve member 33 is located further in the valve-opening direction C1 than the stopper 36 and the stopper 36 is located at the restriction position. The length of time between the point in time t22 and the point in time t23 is set to time for the valve member 33 to be rotated to a position further in the valve-opening direction C1 than the stopper 36 by setting the pump drive amount DP to the third drive amount DP3, or time that is slightly longer than that time. Thus, the controller 61 can determine as described above on the condition that the point in time has reached the point in time t23 after the pump drive amount DP was changed to the third drive amount DP3. At the point in time t23, the controller 61 ends the cancellation process. Subsequently, the pump drive amount DP is adjusted within a range of the normal drive region DPR.

When the radiator flow rate RFR can be adjusted by controlling the pump drive amount DP in such a manner, the controller 61 controls the pump drive amount DP based on the target radiator flow rate amount RFRTr and the target circulation coolant amount CRTr. The controller 61 determines the pump drive amount DP using the lines MP1 and MP2, which are shown in FIG. 6. The target radiator flow rate amount RFRTr and the target circulation coolant amount CRTr are calculated based on, for example, the outlet water temperature Twt.

Figure 8:
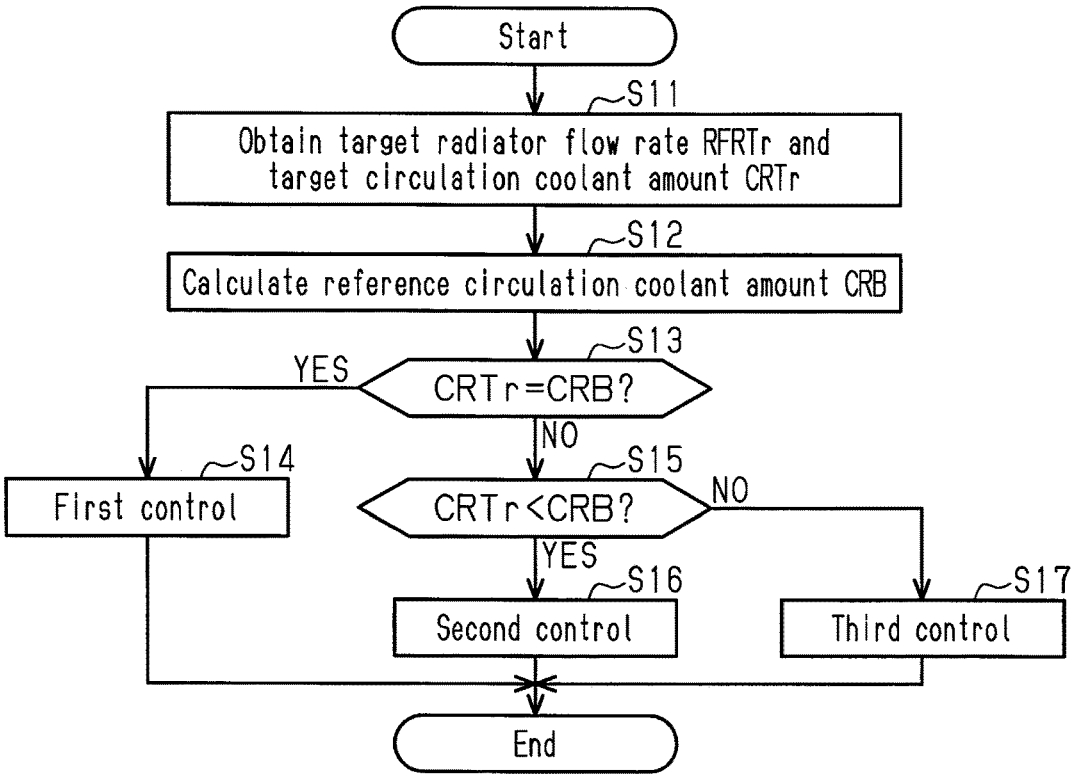
FIG. 8 is a flowchart illustrating the flow of processes executed when an open degree of the flow rate adjustment valve is not maintained after completion of a warm-up operation of the internal combustion engine.

Next, the flow of processes repeatedly executed by the controller 61 when the warm-up operation of the internal combustion engine 10 is complete and the open degree V of the flow rate adjustment valve 28 is not maintained will be described with reference to FIG. 8.

First, in step S11, the controller 61 obtains the target radiator flow rate amount RFRTr and the target circulation coolant amount CRTr. Then, in step S12, the controller 61 uses the first line MP1, which is shown in FIG. 6, to calculate the reference circulation coolant amount CRB. That is, the controller 61 reads, from the first line MP1, the circulation coolant amount CR corresponding to the target radiator flow rate amount RFRTr and sets the read circulation coolant amount CR as the reference circulation coolant amount CRB.

In the next step S13, the controller 61 determines whether the target circulation coolant amount CRTr is equal to the reference circulation coolant amount CRB. The pump drive amount DP is proportional to the circulation coolant amount CR. Thus, the circulation coolant amount CR can be controlled to a value close to the target circulation coolant amount CRTr by controlling the pump drive amount DP to a value corresponding to the target circulation coolant amount CRTr. Further, by controlling the pump drive amount DP to a value corresponding to the reference circulation coolant amount CRB, the radiator flow rate RFR can be controlled to a value close to the radiator flow rate corresponding to the reference circulation coolant amount CRB calculated from the first line MP1. Thus, when the target circulation coolant amount CRTr is equal to the reference circulation coolant amount CRB, the radiator flow rate RFR can be controlled to a value close to the target radiator flow rate amount RFRTr by controlling the pump drive amount DP to a value corresponding to the target circulation coolant amount CRTr. In a case in which the target circulation coolant amount CRTr is not equal to the reference circulation coolant amount CRB, when the pump drive amount DP is controlled to a value corresponding to the target circulation coolant amount CRTr, the radiator flow rate RFR deviates from the target radiator flow rate amount RFRTr.

When it is determined that the target circulation coolant amount CRTr is equal to the reference circulation coolant amount CRB (S13: YES), the process is advanced to the next step S14. In step S14, the controller 61 executes a first control. In the first control, the controller 61 controls the pump drive amount DP to a value corresponding to the target circulation coolant amount CRTr. When an end condition of the first control is satisfied to end the first control, the above-described processes end. The end condition of the first control is that, for example, the target radiator flow rate amount RFRTr is changed and the target circulation coolant amount CRTr is changed.

Figure 9:
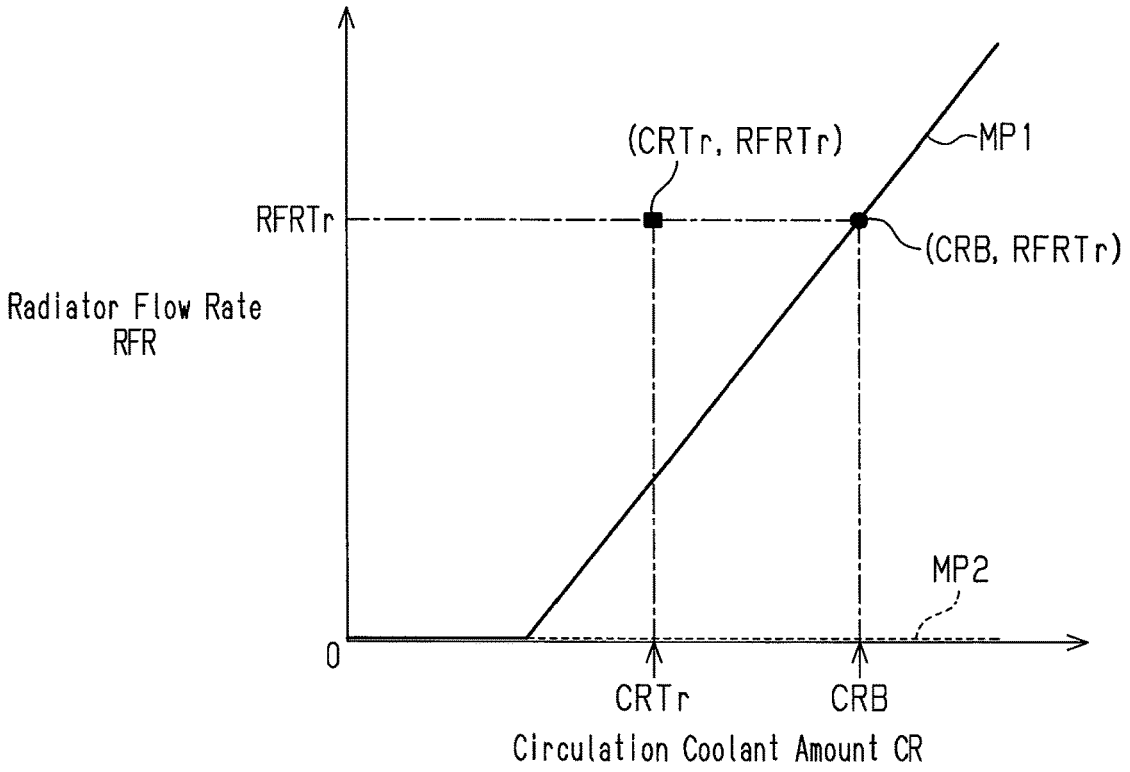
FIG. 9 is a graph showing that a target circulation coolant amount is smaller than a reference circulation coolant amount on the map of FIG. 6.
Figure 10:
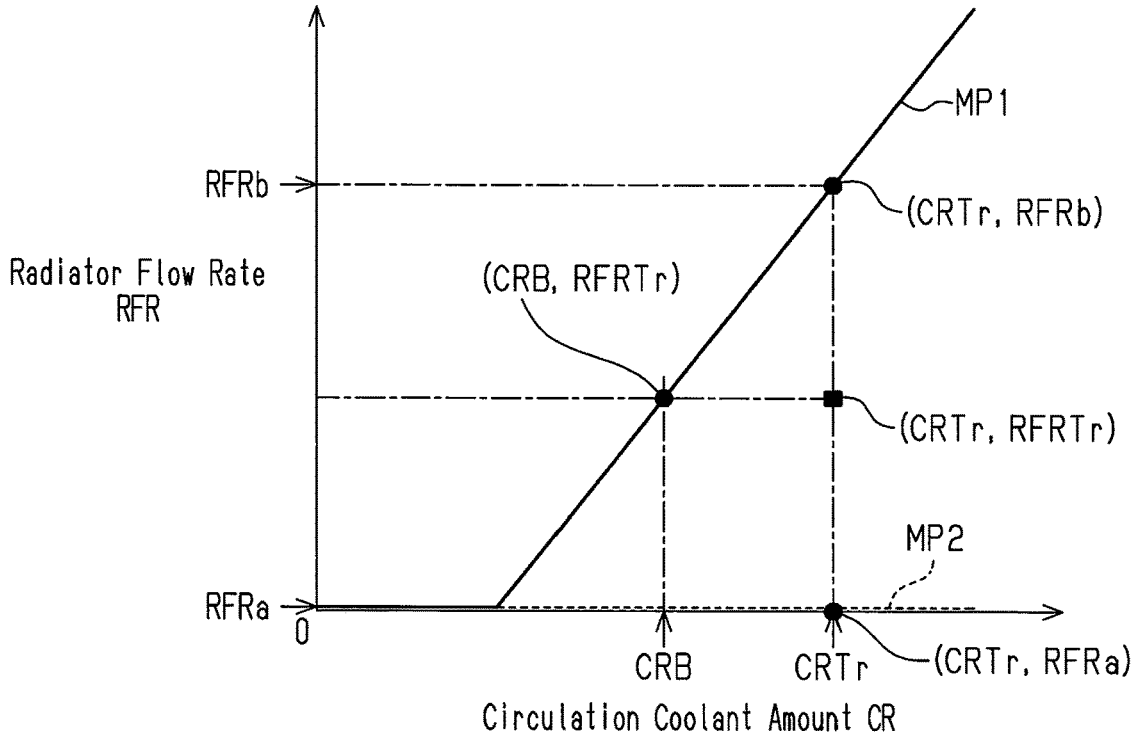
FIG. 10 is a graph showing that the target circulation coolant amount is larger than the reference circulation coolant amount on the map of FIG. 6.

In step S13, when it is not determined that the target circulation coolant amount CRTr is equal to the reference circulation coolant amount CRB (NO), the process is advanced to the next step S15. In step S15, the controller 61 determines whether the target circulation coolant amount CRTr is less than the reference circulation coolant amount CRB. As shown in FIG. 9, in a case in which the target circulation coolant amount CRTr is less than the reference circulation coolant amount CRB, when the pump drive amount DP is controlled to a value corresponding to the target circulation coolant amount CRTr, the radiator flow rate RFR falls below the target radiator flow rate amount RFRTr. As shown in FIG. 10, in a case in which the target circulation coolant amount CRTr is larger than the circulation coolant amount CRB, when the pump drive amount DP is controlled to a value corresponding to the target circulation coolant amount CRTr, the radiator flow rate RFR exceeds the target radiator flow rate amount RFRTr.

Referring back to FIG. 8, when it is determined that the target circulation coolant amount CRTr is less than the reference circulation coolant amount CRB (S15: YES), the process is advanced to the next step S16. In step S16, the controller 61 executes a second control. In the second control, the controller 61 controls the pump drive amount DP to a value corresponding to the reference circulation coolant amount CRB. When an end condition of the second control is satisfied to end the second control, the above-described processes end. The end condition of the second control is the same as the end condition of the first control.

Figure 11:
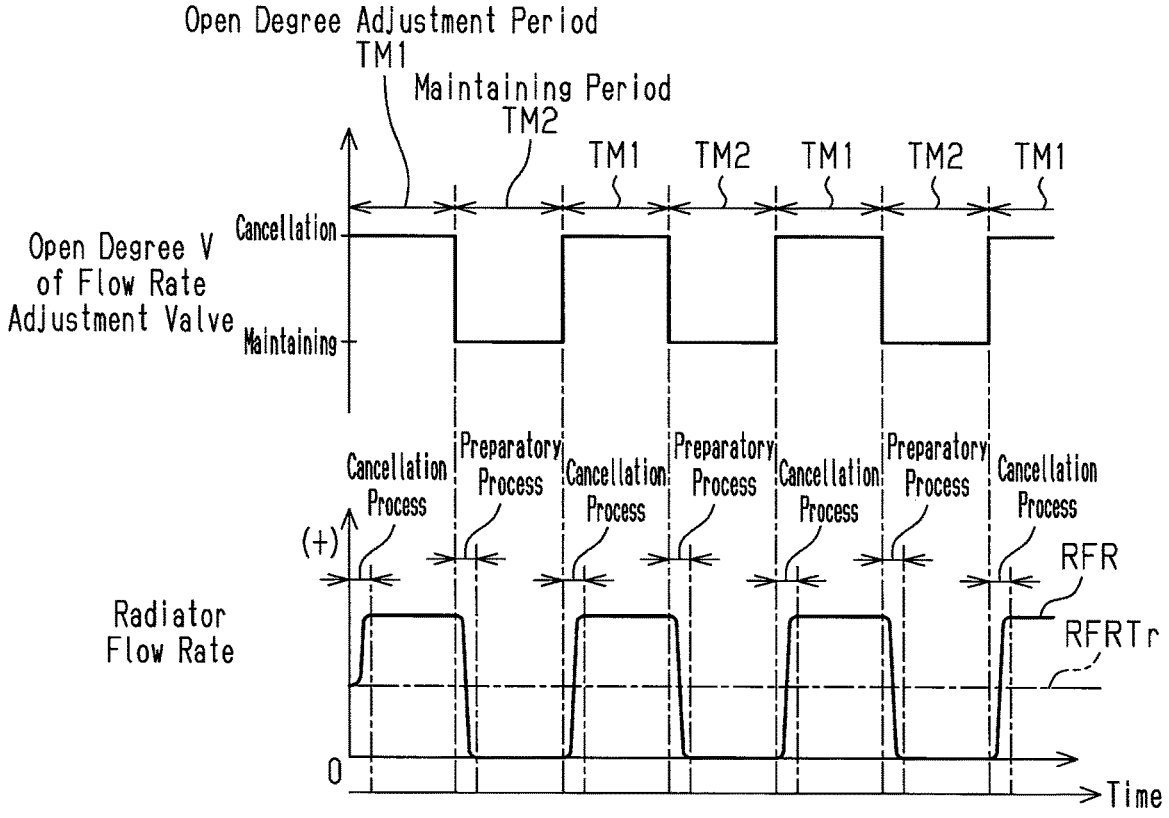
FIG. 11 is a timing diagram illustrating how the open degree of the flow rate adjustment valve is controlled when the target circulation coolant amount is larger than the reference circulation coolant amount.

When it is not determined that the target circulation coolant amount CRTr is less than the reference circulation coolant amount CRB (S15: NO), the target circulation coolant amount CRTr is larger than the reference circulation coolant amount CRB. Thus, the process is advanced to the next step S17. In step S17, the controller 61 executes a third control. In the third control, as shown in FIG. 11, the controller 61 alternately repeats a maintaining period TM2 and an open degree adjustment period TM1.

During the maintaining period TM2, the controller 61 arranges the valve member 33 further in the valve-closing direction C2 than the stopper 36 and arranges the stopper 36 at the restriction position. Further, in this state, the controller 61 maintains the open degree V of the flow rate adjustment valve 28 by controlling the pump drive amount DP to a value corresponding to the target circulation coolant amount CRTr. More specifically, when the maintaining period TM2 starts, the controller 61 executes the preparatory process to restrict rotation of the valve member 33 in the valve-opening direction C1 using the stopper 36. After ending the preparatory process, the controller 61 controls the pump drive amount DP to a value corresponding to the target circulation coolant amount CRTr. In this case, even if the valve member 33 rotates in the valve-opening direction C1, when the valve member 33 engages with the stopper 36, further rotation of the valve member 33 in the valve-opening direction C1 is restricted. This maintains the open degree V.

The length of the maintaining period TM2 is longer than the time for the valve member 33 to be arranged further in the valve-closing direction C2 than the stopper 36 and for the stopper 36 to be arranged at the restriction position by executing the preparatory process. As shown in FIG. 10, the radiator flow rate RFR in the maintaining period TM2 is a first radiator flow rate RFRa (≈0), which is less than the target radiator flow rate amount RFRTr.

During the open degree adjustment period TM1, after cancelling the engagement of the stopper 36 with the valve member 33 to permit rotation of the valve member 33 in the valve-opening direction C1, the controller 61 controls the pump drive amount DP to a value corresponding to the target circulation coolant amount CRTr. More specifically, when the open degree adjustment period TM1 starts, the controller 61 executes the cancellation process to cancel the state in which the open degree V of the flow rate adjustment valve 28 is maintained. After ending the cancellation process, the controller 61 controls the pump drive amount DP to a value corresponding to the target circulation coolant amount CRTr. In this manner, the open degree V is adjusted.

The length of the open degree adjustment period TM1 is longer than the time for the valve member 33 to be rotated to a position further in the valve-opening direction C1 than the stopper 36 after the stopper 36 is moved to the retraction position by executing the cancellation process. As shown in FIG. 10, the radiator flow rate RFR in the open degree adjustment period TM1 is a second radiator flow rate RFRb, which is larger than the target radiator flow rate amount RFRTr.

The length of the open degree adjustment period TM1 and the length of the maintaining period TM2 are respectively set to satisfy the following relational expressions, namely, expression 1 and expression 2. That is, the length of the open degree adjustment period TM1 and the length of the maintaining period TM2 are calculated such that the target radiator flow rate amount RFRTr matches an average value RFRAv of the radiator flow rate RFR during the period in which the open degree adjustment period TM1 and the maintaining period TM2 are repeated. More specifically, the length of the open degree adjustment period TM1 and the length of the maintaining period TM2 are calculated such that as the difference between the target circulation coolant amount CRTr and the reference circulation coolant amount CRB increases, the proportion of the open degree adjustment period TM1 decreases during the period in which the open degree adjustment period TM1 and the maintaining period TM2 are alternately repeated.

$$RFRAv = \frac{RFRa \cdot TM2 + RFRb \cdot TM1}{TM1 + TM2} \quad \text{(Expression 1)}$$

$$RFRTr = RFRAv \quad \text{(Expression 2)}$$

For example, in a case in which the first radiator flow rate RFRa is regarded as 0, when the second radiator flow rate RFRb is equal to a value two times larger than the target radiator flow rate amount RFRTr, the length of the open degree adjustment period TM1 is equal to the length of the maintaining period TM2. When the second radiator flow rate RFRb is greater than the value two times larger than the target radiator flow rate amount RFRTr, the length of the open degree adjustment period TM1 is longer than the length of the maintaining period TM2. When the second radiator flow rate RFRb is less than the value two times larger than the target radiator flow rate amount RFRTr, the length of the open degree adjustment period TM1 is shorter than the length of the maintaining period TM2.

When the end condition of the third control is satisfied, the controller 61 ends the third control and ends the above-described processes. The end condition of the third control is the same as the end condition of the first control.

The operation and advantages of the present embodiment will now be described.

(1) When the warm-up operation of the internal combustion engine 10 is incomplete, the preparatory process is executed. At the point in time the preparatory process ends, the valve member 33 is located further in the valve-closing direction C2 than the stopper 36 and the stopper 36 is located at the restriction position. When the pump drive amount DP is increased in this state, the valve member 33 rotates in the valve-opening direction C1 to engage with the stopper 36. This maintains the open degree V of the flow rate adjustment valve 28. When the open degree V is maintained in this manner, fluctuation of the radiator flow rate RFR is limited even if the pump drive amount DP is changed. Thus, controlling the pump drive amount DP adjusts the circulation coolant amount CR while limiting the fluctuation of the radiator flow rate RFR. This increases the temperature of coolant flowing through the circulation circuit 21 at an early stage.

(2) When the warm-up operation of the internal combustion engine 10 is complete, the cancellation process is executed. This cancels the state in which the open degree V of the flow rate adjustment valve 28 is maintained. Thus, the open degree V can be adjusted by controlling the pump drive amount DP. That is, the radiator flow rate RFR can be adjusted by controlling the pump drive amount DP. In other words, in the present embodiment, even if the flow rate adjustment valve 28 does not include a dedicated actuator that adjusts the rotation angle of the valve member 33, the open degree V and the radiator flow rate RFR can be adjusted.

(3) When the target circulation coolant amount CRTr is equal to the reference circulation coolant amount CRB, the first control is executed to control the pump drive amount DP to a value corresponding to the target circulation coolant amount CRTr. This allows for the control of the radiator flow rate RFR and the circulation coolant amount CR respectively corresponding to the target radiator flow rate amount RFRTr and the target circulation coolant amount CRTr. Thus, the outlet water temperature Twt can be controlled with high accuracy during the engine operation.

(4) In a case in which the target circulation coolant amount CRTr is less than the reference circulation coolant amount CRB, even if the pump drive amount DP is controlled to a value corresponding to the target circulation coolant amount CRTr, the radiator flow rate RFR falls below the target radiator flow rate amount RFRTr. In the present embodiment, when the target circulation coolant amount CRTr is less than the reference circulation coolant amount CRB, the second control is executed to control the pump drive amount DP to a value corresponding to the reference circulation coolant amount CRB, which is larger than the target circulation coolant amount CRTr. In this case, although the circulation coolant amount CR is larger than the target circulation coolant amount CRTr, the radiator flow rate RFR can be approximated to the target radiator flow rate amount RFRTr as compared to when the pump drive amount DP is a value corresponding to the target circulation coolant amount CRTr.

The outlet water temperature Twt is adjusted by controlling the radiator flow rate RFR and the circulation coolant amount CR. Thus, even if the radiator flow rate RFR is controlled to a value close to the target circulation coolant amount CRTr, when the circulation coolant amount CR falls below the target circulation coolant amount CRTr, the outlet water temperature Twt cannot be properly controlled. This may excessively increase the outlet water temperature Twt. To protect the internal combustion engine 10, the outlet water temperature Twt may be excessively high.

In the present embodiment, when the target circulation coolant amount CRTr is less than the reference circulation coolant amount CRB, the circulation coolant amount CR is larger than the target circulation coolant amount CRTr and the radiator flow rate RFR is a value close to the target radiator flow rate amount RFRTr. This prevents the outlet water temperature Twt from becoming excessively high during the engine operation and consequently prevents the internal combustion engine 10 from being overheated.

(5) When the target circulation coolant amount CRTr is larger than the reference circulation coolant amount CRB, the third control is executed. That is, as shown in FIG. 11, during the maintaining period TM2, since the open degree V of the flow rate adjustment valve 28 is maintained, the radiator flow rate RFR is smaller than the target radiator flow rate amount RFRTr. More specifically, the radiator flow rate RFR decreases to approximately 0. Further, after the preparatory process ends during the maintaining period TM2, the pump drive amount DP is controlled to a value corresponding to the target circulation coolant amount CRTr. Thus, although the open degree V is maintained, the circulation coolant amount CR can be controlled to a value close to the target circulation coolant amount CRTr.

During the open degree adjustment period TM1, since the open degree V of the flow rate adjustment valve 28 is not maintained, the radiator flow rate RFR can be controlled to a value corresponding to the pump drive amount DP. Since the pump drive amount DP is a value corresponding to the target circulation coolant amount CRTr, the radiator flow rate RFR is larger than the target radiator flow rate amount RFRTr. More specifically, the radiator flow rate RFR is the second radiator flow rate RFRb as shown in FIG. 10. Further, after the cancellation process ends during the open degree adjustment period TM1, the pump drive amount DP is controlled to a value corresponding to the target circulation coolant amount CRTr. Thus, the circulation coolant amount CR can be controlled to a value close to the target circulation coolant amount CRTr.

During the execution of the third control, the maintaining period TM2 and the open degree adjustment period TM1 are alternately repeated. More specifically, the length of the open degree adjustment period TM1 and the length of the maintaining period TM2 are calculated based on the difference between the target circulation coolant amount CRTr and the reference circulation coolant amount CRB such that the proportion of the open degree adjustment period TM1 changes during the repetition period. During the execution of the third control, the maintaining period TM2 and the open degree adjustment period TM1 are alternately repeated based on the calculation result. Thus, the average value of the radiator flow rate RFR during the execution period of the third control, that is, the average value RFRAv during the period in which the maintaining period TM2 and the open degree adjustment period TM1 are repeated, can be approximated to the target radiator flow rate amount RFRTr.

During the execution of the third control, the pump drive amount DP is set to a value corresponding to the target circulation coolant amount CRTr except during the execution of the cancellation process and the preparatory process. Thus, during the execution period of the third control, a deviation between the circulation coolant amount CR and the target circulation coolant amount CRTr is limited.

This limits a deviation between the radiator flow rate RFR and the target radiator flow rate amount RFRTr while limiting a deviation between the circulation coolant amount CR and the target circulation coolant amount CRTr. Thus, the outlet water temperature Twt can be controlled with high accuracy during the engine operation.

The above-described embodiment may be modified as follows. The above-described embodiments and the following modifications can be combined as long as the combined modifications remain technically consistent with each other.

Even when the warm-up operation of the internal combustion engine 10 is not yet complete, rotation of the valve member 33 in the valve-opening direction C1 does not have to be restricted by the stopper 36. Even when the rotation of the valve member 33 in the valve-opening direction C1 is not restricted by the stopper 36, as long as the circulation coolant amount CR is controlled to the switch coolant amount CRA or smaller, the temperature of coolant flowing through the circulation circuit 21 can be readily increased.

As long as the cancellation process is executed so that the valve member 33 can rotate to a position further in the valve-opening direction C1 than the restriction position before the stopper 36 moves to the restriction position, the third drive amount DP3 may be a value smaller than the upper limit DPRu1.

As long as the valve member 33 is rotated in the valve-closing direction C2 to engage with the restriction portion 34 and the stopper 36 can be moved to the retraction position, the first drive amount DP1 may be a value greater than or equal to the lower limit DPR ll of the normal drive region DPR. When the first drive amount DP1 is a value greater than or equal to the lower limit DPR ll in such a manner, the second drive amount DP2 is set to a value larger than the lower limit DPR ll.

Figure 12:
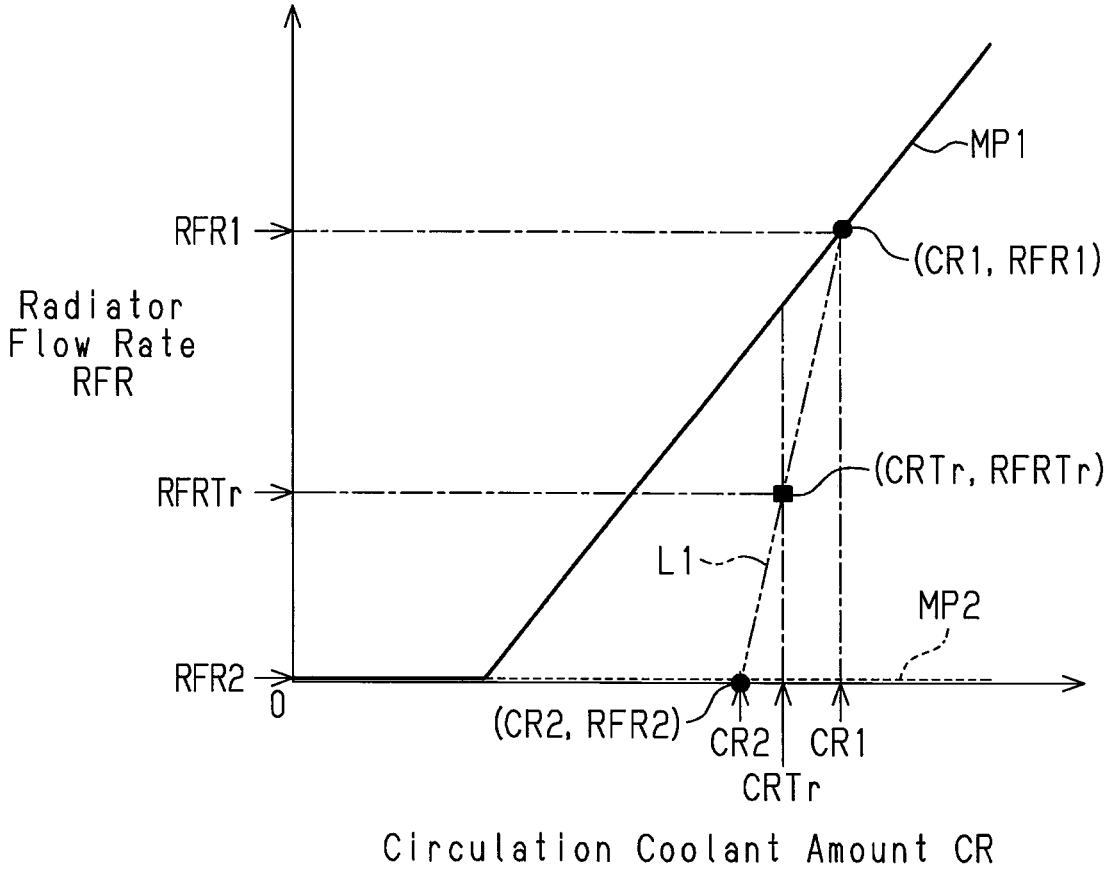
FIG. 12 is a graph illustrating how control is performed in a modification.

In the third control, as long as the average value RFRAv can be approximated to the target radiator flow rate amount RFRTr by alternately repeating the maintaining period TM2 and the open degree adjustment period TM1, the pump drive amount DP in the maintaining period TM2 and the pump drive amount DP in the open degree adjustment period TM1 may be values that differ from values corresponding to the target circulation coolant amount CRTr. For example, as shown in FIG. 12, the pump drive amount DP in the open degree adjustment period TM1 may be a first circulation coolant amount CR1, which is larger than the target circulation coolant amount CRTr. In this case, the radiator flow rate RFR in the open degree adjustment period TM1 is the first radiator flow rate RFR1, which is larger than the target radiator flow rate amount RFRTr.

Subsequently, an example of how to determine the pump drive amount DP during the maintaining period TM2 in this case will be described. As shown by the graph in FIG. 12, the pump drive amount DP in the maintaining period TM2 is the pump drive amount corresponding to a point of intersection (second circulation coolant amount CR2 and second radiator flow rate RFR2) at which the second line MP2 intersects a straight line L1, which passes through a point (CR1 and RFR1) on the first line MP1 and a point (CRTr and RFRTr) representing the target circulation coolant amount CRTr and the target radiator flow rate amount RFRTr. The second circulation coolant amount CR2 is smaller than the target circulation coolant amount CRTr. Thus, the second radiator flow rate RFR2 is smaller than the target radiator flow rate amount RFRTr.

In this case, the length of the open degree adjustment period TM1 and the length of the maintaining period TM2 are set based on the relationship between the circulation coolant amount CR and the radiator flow rate RFR in the maintaining period TM2 (i.e., second circulation coolant amount CR2 and second radiator flow rate RFR2) and the circulation coolant amount CR and the radiator flow rate RFR in the open degree adjustment period TM1 (i.e., the first circulation coolant amount CR1 and the first radiator flow rate RFR1).

In the flow rate adjustment valve 28 of the above-described embodiment, the stopper 36 is moved between the restriction position and the retraction position by adjusting the pressure in the connection passage 42. However, as long as the flow rate adjustment valve includes a stopper that moves between the restriction position and the retraction position, the flow rate adjustment valve may be a valve with a structure that differs from the structure of the flow rate adjustment valve 28 of the above-described embodiment. For example, the flow rate adjustment valve may be a valve that includes an actuator that outputs a drive force to a stopper and drives the actuator to move the stopper between the restriction position and the retraction position. In this case, the actuator may be controlled by the controller 61. This allows rotation of the valve member 33 and movement of the stopper to occur at the same time. In the configuration in which the stopper is moved by operating the actuator in this manner, the flow rate adjustment valve may include a mechanism that maintains the stopper at the restriction position when arranging the stopper at the restriction position and restricting the rotation of the stopper in the valve-opening direction C1. This limits an increase in the power consumption when the open degree V of the flow rate adjustment valve is maintained.

In the above-described embodiment, the minimum value of the open degree V of the flow rate adjustment valve 28 is the set open degree VA. As long as fluctuation in the radiator flow rate RFR can be limited by maintaining the open degree V at the set open degree VA, the set open degree VA may be set to a value larger than the minimum value of the open degree V.

The flow rate adjustment valve 28 may be arranged upstream of the radiator 27 in the radiator passage 23.

The electric pump 26 does not have to be used as long as the pump can change the discharge amount of coolant. For example, a pump including an engine-driven pump and a valve that operates to adjust the discharge amount of coolant from a coolant discharge portion may be used. In this case, the controller 61 controls operation of the valve to control the pump discharge amount.

As long as the flow rate adjustment valve does not have to maintain the open degree V, the flow rate adjustment valve may be a valve that does not include the stopper 36. Even in this case, the radiator flow rate RFR can be adjusted by controlling the pump drive amount DP.

The control device 60 and the controller 61 are not limited to a device that includes a CPU and a memory and executes software processing. For example, at least part of the processes executed by the software in the above-described embodiment may be executed by hardware circuits dedicated to execution of these processes (such as ASIC). That is, the control device 60 and the controller 61 may be modified as long as it has any one of the following configurations (a) to (c). (a) A configuration including a processor that executes all of the above-described processes according to programs and a program storage device such as a ROM that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above-described processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A cooling apparatus for an internal combustion engine, the cooling apparatus comprising:

a circulation circuit for coolant in the internal combustion engine;

a pump arranged on the circulation circuit, the pump being configured to change a discharge amount of coolant;

a radiator and a flow rate adjustment valve arranged on the circulation circuit in series with the pump;

a bypass passage arranged on the circulation circuit, wherein coolant that has flowed through a cylinder block and a cylinder head of the internal combustion engine flows through the bypass passage so as to bypass the radiator and the flow rate adjustment valve;

a controller configured to control a pump discharge amount that is a discharge amount of coolant in the pump, wherein:

the flow rate adjustment valve includes:

a valve member configured to rotate to change an open degree of the flow rate adjustment valve, and a valve member biasing component configured to bias the valve member in a valve-closing direction that is a rotation direction in which the open degree decreases, the valve member is configured to rotate in a valve-opening direction that is a rotation direction in which the open degree increases when a pressure difference increases between a position upstream of the valve member and a position downstream of the valve member in a flow direction of coolant in the circulation circuit and rotate in the valve-closing direction when the pressure difference decreases, and the controller is configured to increase the pump discharge amount as a target radiator flow rate that is a target of an amount of coolant passing through the radiator increases; and a memory configured to store, when the open degree changes as the pump discharge amount changes, a map indicating a relationship between a radiator flow rate that is an amount of coolant passing through the radiator and a circulation coolant amount that is an amount of coolant circulating in the internal combustion engine, wherein:

the cooling apparatus is configured to control the circulation coolant amount and the radiator flow rate through control of the pump discharge amount by the controller based on the target radiator flow rate and a target circulation coolant amount that is a target of the circulation coolant amount, the map indicates the relationship in which the circulation coolant amount is larger when the radiator flow rate is large than when the radiator flow rate is small, when the target radiator flow rate is input to the map, the circulation coolant amount that is output from the relationship indicated on the map is defined as a reference circulation coolant amount, and the controller is configured to set the pump discharge amount to a value corresponding to the target circulation coolant amount when the target circulation coolant amount is equal to the reference circulation coolant amount.

2. The cooling apparatus according to claim 1, wherein the controller is configured to set the pump discharge amount to a value corresponding to the reference circulation coolant amount when the target circulation coolant amount is less than the reference circulation coolant amount.

3. A cooling apparatus for an internal combustion engine, the cooling apparatus comprising:

a circulation circuit for coolant in the internal combustion engine;

a pump arranged on the circulation circuit, the pump being configured to change a discharge amount of coolant;

a radiator and a flow rate adjustment valve arranged on the circulation circuit in series with the pump;

a bypass passage arranged on the circulation circuit, wherein coolant that has flowed through a cylinder block and a cylinder head of the internal combustion engine flows through the bypass passage so as to bypass the radiator and the flow rate adjustment valve; and a controller configured to control a pump discharge amount that is a discharge amount of coolant in the pump, wherein:

the flow rate adjustment valve includes:

a valve member configured to rotate to change an open degree of the flow rate adjustment valve, and a valve member biasing component configured to bias the valve member in a valve-closing direction that is a rotation direction in which the open degree decreases, the valve member is configured to rotate in a valve-opening direction that is a rotation direction in which the open degree increases when a pressure difference increases between a position upstream of the valve member and a position downstream of the valve member in a flow direction of coolant in the circulation circuit and rotate in the valve-closing direction when the pressure difference decreases, the controller is configured to increase the pump discharge amount as a target radiator flow rate that is a target of an amount of coolant passing through the radiator increases, the flow rate adjustment valve includes a stopper that moves between a restriction position at which the stopper engages with the valve member to restrict rotation of the valve member and a retraction position at which the stopper does not engage with the valve member and the rotation of the valve member is permitted, and the controller is configured to execute, when maintaining the open degree, a preparatory process of moving the stopper to the restriction position after arranging the stopper at the retraction position and controlling the pump discharge amount to arrange the valve member further in the valve-closing direction than the stopper.

4. The cooling apparatus according to claim 3, comprising a memory configured to store, when the open degree changes as the pump discharge amount changes, a map indicating a relationship between a radiator flow rate that is an amount of coolant passing through the radiator and a circulation coolant amount that is an amount of coolant circulating in the internal combustion engine, wherein the cooling apparatus is configured to control the circulation coolant amount and the radiator flow rate through control of the pump discharge amount by the controller based on the target radiator flow rate and a target circulation coolant amount that is a target of the circulation coolant amount, the map indicates the relationship in which the circulation coolant amount is larger when the radiator flow rate is large than when the radiator flow rate is small, when the target radiator flow rate is input to the map, the circulation coolant amount that is output from the relationship indicated on the map is defined as a reference circulation coolant amount, and the controller is configured to alternately repeat a maintaining period and an open degree adjustment period when the target circulation coolant amount is larger than the reference circulation coolant amount, the maintaining period being a period in which the open degree is maintained by arranging the valve member further in the valve-closing direction than the stopper, arranging the stopper at the restriction position, and then setting the pump discharge amount to a value corresponding to the target circulation coolant amount, and the open degree adjustment period being a period in which the pump discharge amount is set to a value corresponding to the target circulation coolant amount by cancelling engagement of the stopper with the valve member and permitting the rotation of the valve member in the valve-closing direction.

5. The cooling apparatus according to claim 4, the controller is configured to decrease, when the target circulation coolant amount is larger than the reference circulation coolant amount, a proportion of the open degree adjustment period during a period in which the maintaining period and the open degree adjustment period are alternately repeated as a difference between the target circulation coolant amount and the reference circulation coolant amount increases.

6. The cooling apparatus according to claim 3, wherein the controller is configured to:

maintain a state in which the rotation of the valve member in the valve-opening direction is restricted by arranging the stopper at the restriction position to engage the stopper with the valve member when a warm-up operation of the internal combustion engine is not complete, and permit the rotation of the valve member in the valve-opening direction and control the pump discharge amount based on the target radiator flow rate when the warm-up operation of the internal combustion engine is complete.

* * * * *